US005575561A

United States Patent [19]

Rohwer

[11] Patent Number: 5,575,561

[45] Date of Patent: Nov. 19, 1996

[54] IN-LINE MIXER FOR DISPERSIONS

[76] Inventor: Gary L. Rohwer, 29575 Bar Diamond La., Parma, Id. 83660

[21] Appl. No.: 521,791

[22] Filed: Aug. 31, 1995

Related U.S. Application Data

[63] Continuation-in-part of Ser. No. 189,154, Jan. 27, 1994, Pat. No. 5,460,449.

[51] Int. Cl.[6] ..... B01F 5/06

[52] U.S. Cl. ..... 366/336

[58] Field of Search ..... 366/336, 337, 366/338, 339, 340; 138/38, 39, 42

[56] References Cited

U.S. PATENT DOCUMENTS

| | | | |
|---|---|---|---|
| 2,504,678 | 4/1950 | Gardner | 366/336 |
| 2,890,868 | 6/1959 | Potchen | 366/336 |
| 3,249,341 | 5/1966 | Stanford | 366/336 |
| 3,744,763 | 7/1973 | Schoring | 366/317 |
| 4,333,729 | 6/1982 | Marugg | 417/313 |
| 4,352,573 | 10/1982 | Pandolfe | 366/336 |
| 4,909,635 | 3/1990 | Lec Offre | 366/337 |
| 4,944,602 | 7/1990 | Buschelberger | 366/337 |
| 5,145,256 | 9/1992 | Wiemers | 366/337 |

*Primary Examiner*—Robert W. Jenkins
*Attorney, Agent, or Firm*—Margaret M. Dunbar

[57] ABSTRACT

The invention is an in-line mixer without moving parts, with a generally conical shear head pointed in the upstream direction within a pipe, and centered near the downstream side of an annular seating ring fastened to the inside surface of the pipe. In the upstream, slanted face, or high pressure side of the shear head, there is a series of generally circular ports bored through the shear head. The slanted face of the conical shear head extends through the center of the seating ring in the upstream direction, and is adjusted to be located very close, about 0.020 inches, to the downstream side of the seating ring. At the downstream end of the slanted face of the shear head is a first sharp, approximately 90 degree edge leading away from the inside surface of the pipe in the downstream direction, which first edge is adjusted to be located very close, about 0.004 inches, to the inside surface of the pipe. This way, intense shearing forces are created at the edge of the downstream side of the annular seating ring near the inlets of the ports, and at the edge of the downstream end of the slanted face of the shear head near the inside surface of the pipe. Also, intense mixing forces are created at the downstream side of the annular seating ring near the inside surface of the pipe, and at the back of the shear head.

10 Claims, 11 Drawing Sheets

IN-LINE MIXER FOR DISPERSIONS

RELATED APPLICATIONS

This application is a continuation-in-part application of application Ser. No. 08/189,154, filed Jan. 27, 1994, now U.S. Pat. No. 5,460,449.

DESCRIPTION

BACKGROUND OF THE INVENTION

1. Technical Field

This invention relates generally to mixers, and more specifically, to in-line mixers without moving parts. The mixer of this invention provides intense shearing and mixing forces from the energy of fluid mixtures passing through it and around it to provide stable, well-distributed dispersions, without the need for moving pans and without the entrainment of air into the dispersions.

2. Background Art

U.S. Pat. No. 3,744,763 (Schnöring et al.) discloses a homogenizing machine with a rotor, an end face of which has rings formed with recesses. The rotor rings revolve between similar rings arranged on the inside of the rotor housing to help create shearing and mixing forces and an emulsion therein.

U.S. Pat. No. 4,333,729 (Marugg) discloses a homogenizing unit with a conical bore hole and a conical plunger, the plunger having successive ring-shaped steps on it.

U.S. Pat. No. 4,909,635 (Lecoffre et al.) discloses a homogenizing machine with a perforated tubular insert having a solid diagonal baffle as a flow director in its center.

U.S. Pat. No. 4,944,602 (Buschelburger) discloses a homogenizing machine with a nozzle, a cutting edge between the inlet and the outlet, and downstream of the cutting edge, a circumferential recess. The mixture in the machine is subjected to an acceleration zone at the cutting edge, and a micro-turbulence zone in the circumferential recess.

Still, there is a need for an in-line mixer for dispersions which is of simple and inexpensive construction, without moving parts, and which operates without introducing air or gas bubbles into the dispersion.

DISCLOSURE OF INVENTION

The invention is an in-line mixer without moving parts, with a generally conical shear head pointed in the upstream direction within a fluid conduit or passageway, preferably a pipe, and centered near the downstream side of an annular seating ring fastened to the inside surface of the pipe. In the upstream, slanted face, or high pressure side, of the conical shaped flow mixer or shear head, there is a series of generally circular ports bored through the shear head generally parallel to the center-line of the seating ring and the pipe. The ports extend through the shear head to its downstream, or low pressure side.

The slanted face of the conical shear head extends partially through the center of the seating ring in the upstream direction, and is adjusted to be located very close, about 0.020 inches, to the downstream side of the seating ring when compounds such as cow blood and fat are being processed by the mixer. At the downstream end of the slanted face of the shear head is a first sharp, approximately 90 degree edge leading away from the inside surface of the pipe in the downstream direction, which first edge is adjusted to be located very close, about 0.004 inches, to the inside surface of the pipe when compounds such as cow blood and fat are being processed by the mixer. These clearances may vary slightly, depending on the composition, viscosity, percent solids, etc. of the liquid being processed by the mixer. The first sharp 90 degree edge transitions into a generally flat surface on the downstream, outside circumference of the shear head, which surface ends at a second sharp, approximately 90 degree edge leading away from the inside surface of the pipe, but in the upstream direction. The second, sharp 90 degree edge transitions into the back side of the shear head at approximately the location of the outlet of the ports in the shear head.

The ports in the slanted face of the shear head are arranged to be evenly spaced-apart in a ring around the center-line of the seating ring and pipe. Preferably, the center of each port is arranged to be at the same perpendicular distance from the inside surface of the pipe as the edge of the downstream side of the seating ring. The ports are sized, such that in a plane perpendicular to the longitudinal axis of the pipe, the sum of the cross sectional area of the ports is equal to the area between the pipe and the shear head.

As material flows through the mixer, intense shearing forces are created at the edge of the downstream side of the annular seating ring near the inlets of the ports, at the edge of the downstream end of the slanted face of the shear head near the inside surface of the pipe, and near the outlet of the ports.

Additional objects, advantages and novel features of the invention will be set forth in part in the description that fellows, and in part will become apparent to those skilled in the art upon examination of the following or may be learned by practice of the invention. The objects and advantages of the invention may be realized and attained by means of the instrumentalities and combinations particularly pointed out in the appended claims.

BEST MODE FOR CARRYING OUT INVENTION

Figure 1:
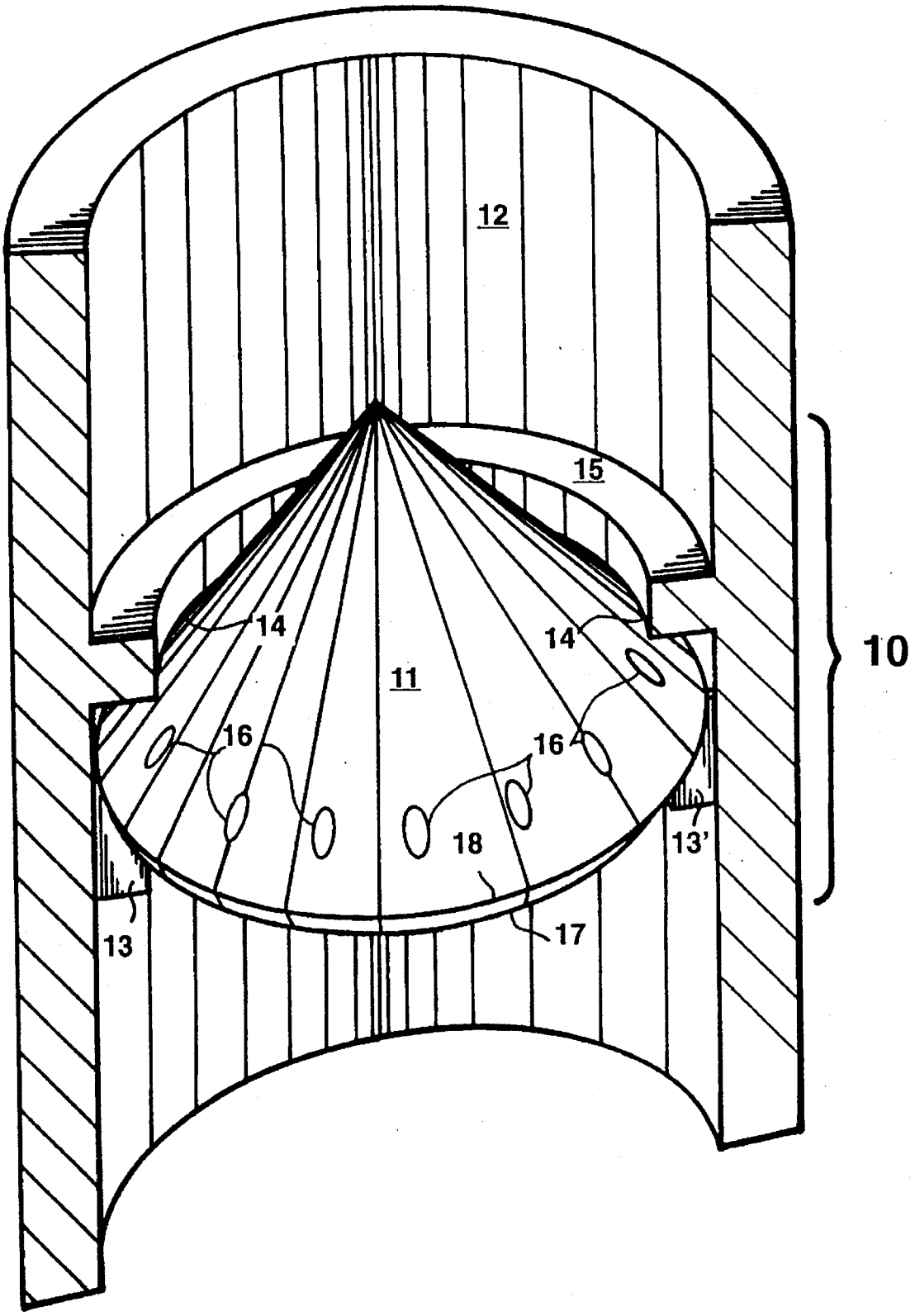
FIG. 1 is an isometric, partial cross-sectional view of one embodiment of the invention.
Figure 2:
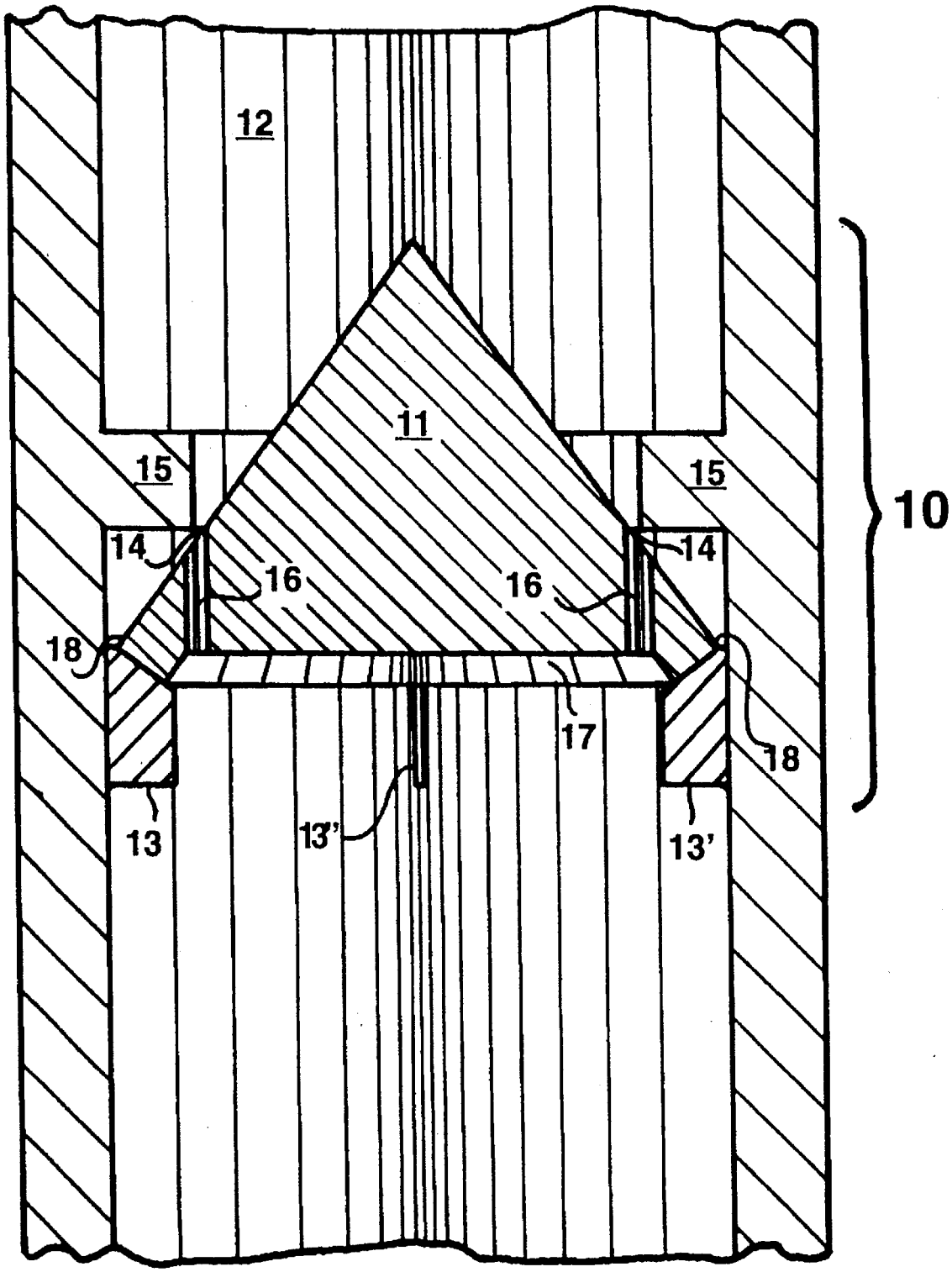
FIG. 2 is a side, cross-sectional view of the embodiment depicted in FIG. 1.
Figure 3:
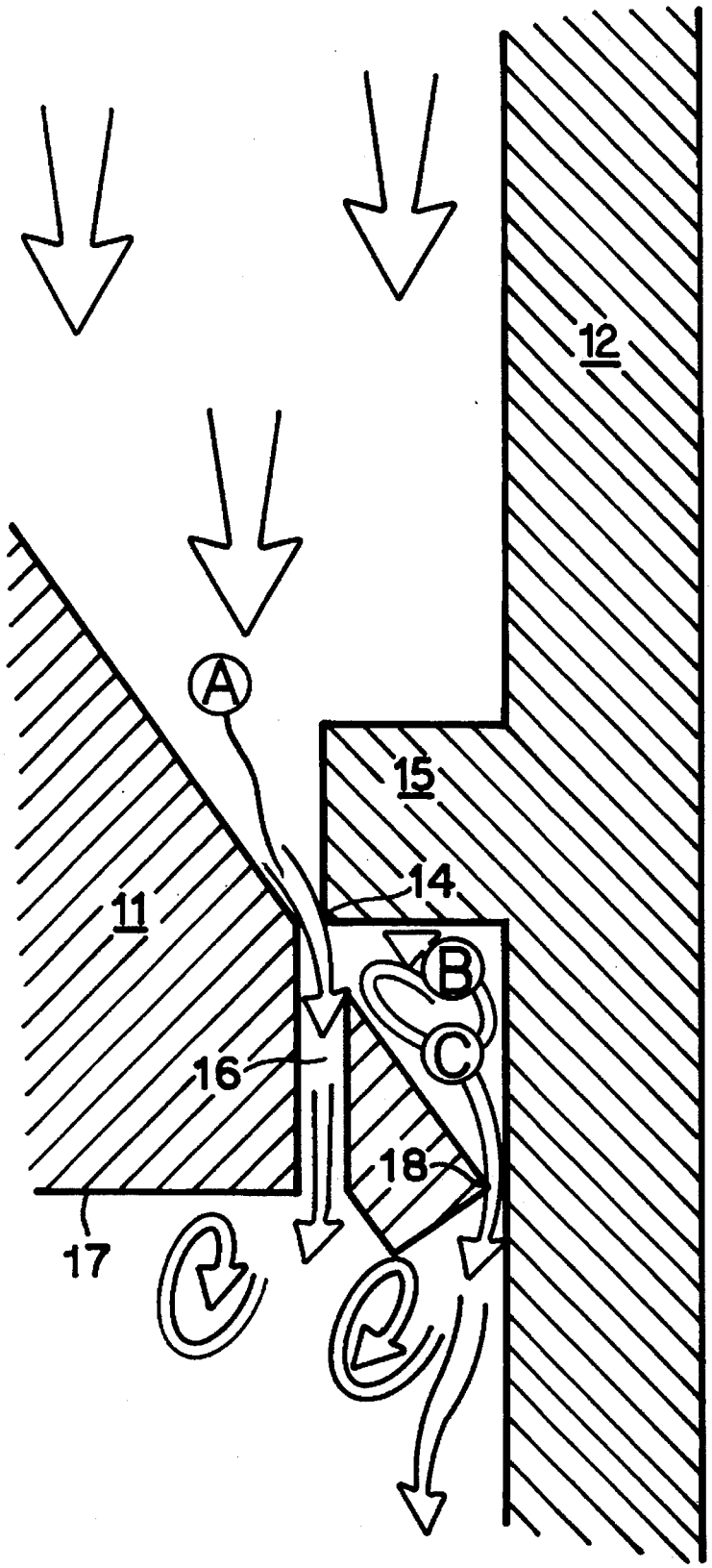
FIG. 3 is a schematic, partial, cross-sectional view of the embodiment depicted in FIGS. 1 and 2.

Referring to the FIGS. 1–3, there is depicted generally at 10 one embodiment of the in-line mixer of this invention. Mixer 10 has conical shear head 11 centered within a tubular housing or pipe 12 around which unmixed material is passed, thus shearing the unmixed material to generate mixed material. The pointed end or conical face of shear head 11 is colocated along the longitudinal axis of the pipe, which can be seen in FIGS. 1, 2 and 5 and directed upstream relative to material flow through pipe 12. Lugs 13, 13', and 13" are welded to the downstream or base surface of the shear head 11 and are subsequently welded to the inside surface of the pipe 12 in order to hold shear head 11 securely within the pipe 12 and centered in the passageway. Slightly upstream of lugs 13, 13' and 13" is annular ring 15 on the inside surface of pipe 12 which provides an obstruction to material flow through the pipe 12. Ring 15 has a sharp, downstream inner edge 14. Shear head 11 is positioned so that the surface of its upstream, slanted face is very close to the downstream, inner edge 14 of annular seating ring 15 as seen in FIGS. 1–3.

The upstream side of annular seating ring 15 may also incorporate a smooth, tapered transition from the inside surface of pipe 12 to the upstream, inner edge of the ring. This way, pressure drop and residence time for the fluid entering the mixer may be minimized. However, if high pressure drop is not a problem for the particular mixing process, or if it is desired to maximize turbulence and residence time at the entrance to the mixer, a rectangular, annular ring, with sharp upstream and downstream inner edges as depicted in FIGS. 1–3 and 5, may be used.

The slanted face or cone portion of shear head 11 extends through the center of annular seating ring 15 in the upstream direction, and is positioned to be located very close, about 0.020 inches away, to the downstream, inner edge 14 of seating ring 15 when compounds such as cow blood and fat are being processed by the mixer, for example. Referring to FIG. 3, as material passes through the mixer 10, a first mixing zone is created in the area denoted Region A wherein high shear force is created at the upstream, inner edge 14 of seating ring 15 when fluid in pipe 12 passes between edge 14 and the upstream face of shear head 11. The size of the first mixing zone denoted Region A may be varied by locating the slanted face of shear head 11 nearer to or farther from the downstream, inner edge 14 of seating ring 15. Depending upon the composition, viscosity, percent solids, etc., efficient mixing may be obtained by adjusting the clearance between the annular ring 15 and shear head 11.

In the upstream, slanted face of the shear head 11 there are a series of generally cylindrical bypass ports 16 bored through the shear head generally parallel to the center-line of the seating ring 15 and pipe 12, as shown in FIG. 1–3. The ports 16 extend through the shear head 11 from its upstream side to its downstream side, or back 17, thereby bypassing mixing region C as shown in FIG. 3. The ports 16, which may number from about five to about twenty, are arranged radially and generally evenly-spaced apart. Preferably, the center of each port 16 is located so that it is at the same perpendicular Distance B from the inside surface of pipe 12 as the downstream, inner edge 14 of seating ring 15. It is important to note the distance B to the center of the ports 16 and the downstream edge 14 may be varied in order to create more or less turbulence at the inlet to the ports 16, with more turbulence being developed with greater relative distance B.

At the downstream end of the slanted face of shear head 11 is a first sharp, approximately 90 degree edge 18 leading away from the inside surface of pipe 12 in the downstream direction, as can be seen in FIG. 3. This first sharp edge 18 is adjusted to be located very close, about 0.004 inches from the inside surface of pipe 12. The inside surface of pipe 12, mixer 11, and ring 15 thus define a cross-sectional area, Region C, wherein high shear force is created at the sharp edge 18 as fluid passes through the mixer, as can be seen in FIG. 3. The size of Region C may be varied by locating the first sharp edge 18 nearer to or farther from the inside surface of pipe 12. This way, depending upon the composition, viscosity, percent solids, etc. of the liquid being processed by the mixer, efficient mixing may still be obtained by varying the intensity of the shear force in Region A, with additional shear force being generated within the smaller Region C.

The ports 16 are sized so that the sum of their cross-sectional area in a plane perpendicular to the center-line of the seating ring 15 and pipe 12 is approximately equal to the area of the annular space, Region C, between the first sharp edge 18 of shear head 11 and the inside surface of pipe 12.

Preferably, the component parts of the mixer of this invention are precision machined to fit and cooperate together exactly. For example, first the inside surface of pipe 12 is machined to ensure that it is perfectly round and of an exact diameter. Then, seating ring 15 is machined to ensure also that it is perfectly round and of an exact diameter. The exact location of seating ring 15 within pipe 12 may be ensured by, for example, machining a circumferential ledge into the inside surface of pipe 12 to act as a stop for seating ring 15.

Then, the exact location of shear head 11 relative to seating ring 15 may be ensured by first tack welding lugs 13, 13' and 13" to shear head 11, and then tack welding the lugs to the inside surface of pipe 12. At this point, care must be exercised to maintain the exact distance between the slanted face of shear head 11 and the downstream, inner edge 14 of seating ring 15, and at the same time the exact distance between first, sharp edge 18 and the inside surface of pipe 12. Similar care must also be exercised in manufacturing the conical shear head 11 and ports 16. This way, the component parts of the mixer will cooperate together to provide the intense shear and mixing forces necessary to make good dispersions.

Generally, high-grade pipe fitting and machining materials and techniques will suffice for manufacturing the mixer of this invention, depending on the intended use of the resulting dispersion. For food grade applications, for example, all the pans must be stainless steel, and they must be readily disassembled for cleaning. For other industrial applications, carbon steel may suffice. We prefer to use stainless steel materials, for example 316 stainless, schedule 80 pipe for the pipe section 12. Also, depending on the application, we prefer similar materials for the shear head 11 and seating ring 15. These components of the mixer of this invention may be manufactured and assembled by conventional techniques, provided the care described above is given to the methods.

Figure 4:
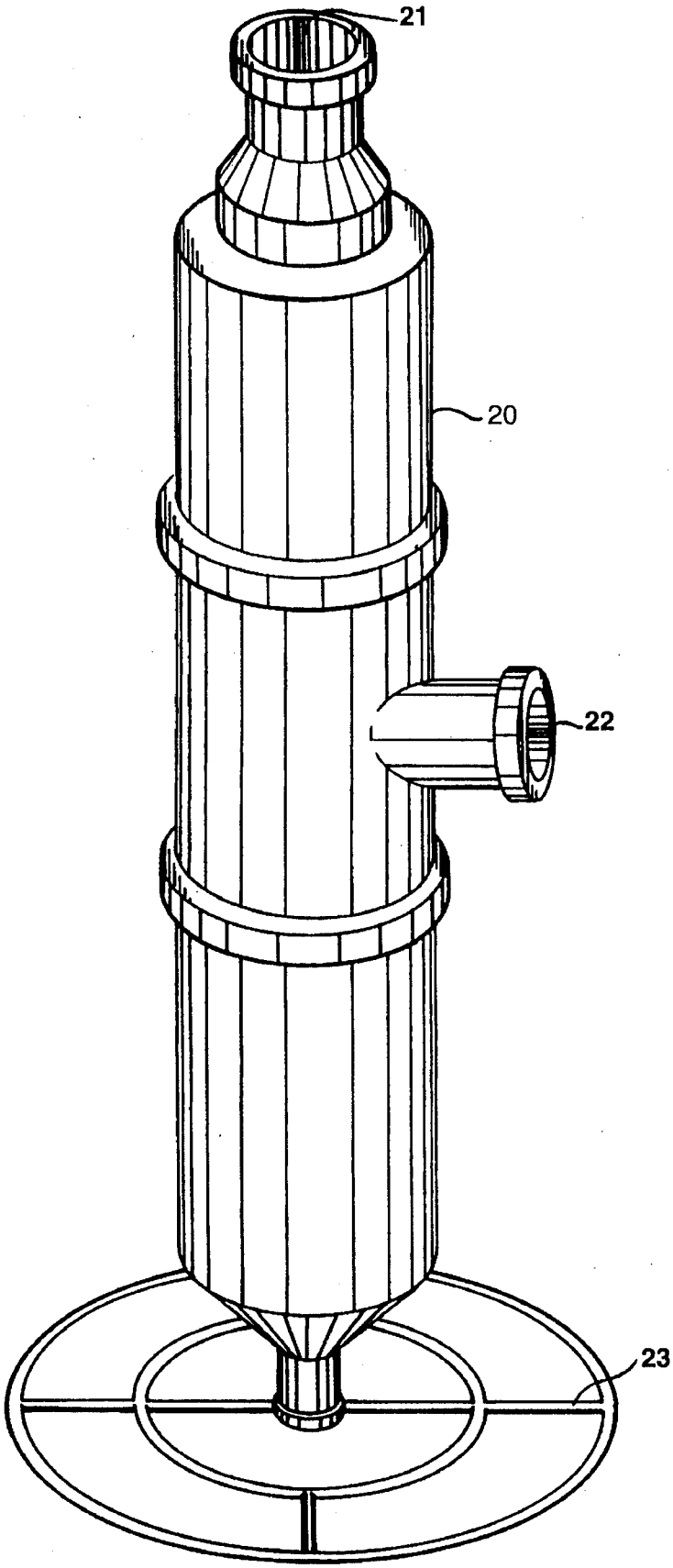
FIG. 4 is an isometric view of another embodiment of the invention.
Figure 5:
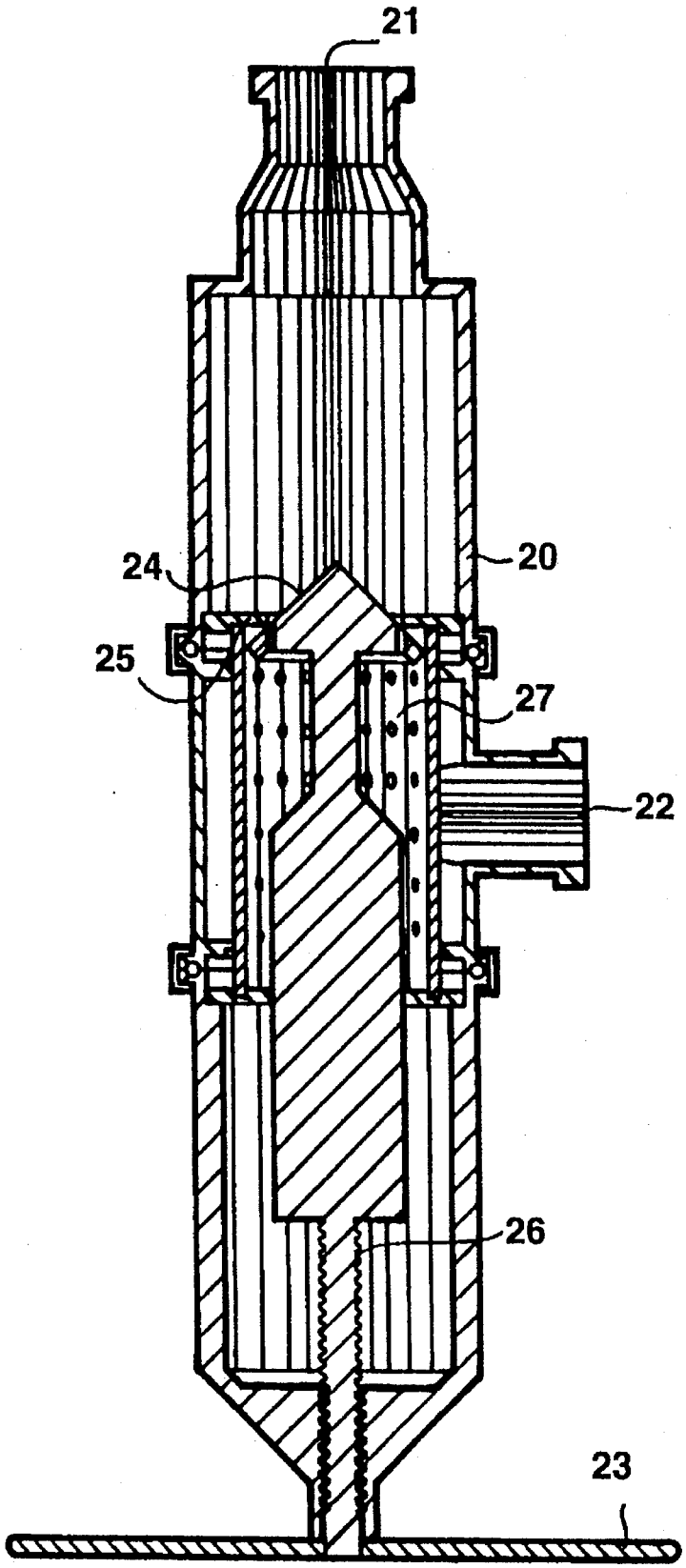
FIG. 5 is a cross-sectional, side view of the embodiment depicted in FIG. 4.

An alternative embodiment 20 of the mixer of this invention is depicted in FIGS. 4 and 5. This mixer has an inlet section 21 and an outlet section 22. Also, it has an adjustment mechanism 23 for adjusting the distance between the upstream, slanted face of its shear head 24 and its seating ring 25. This way, different liquids may be processed by the mixer, and different Region A's, Distances B and Region C's provided in the mixer, by simply adjusting the travel of shaft 26 connected between adjustment mechanism 23 and shear head 24. Optionally in this embodiment, annular perforated mixing basket 27 may also be used to provide additional mixing of the liquid after it has passed shear head 24 and seating ring 25, or to provide primary mixing if shaft 26 is withdrawn all the way to remove shear head 24 from within seating ring 25.

Figure 6:
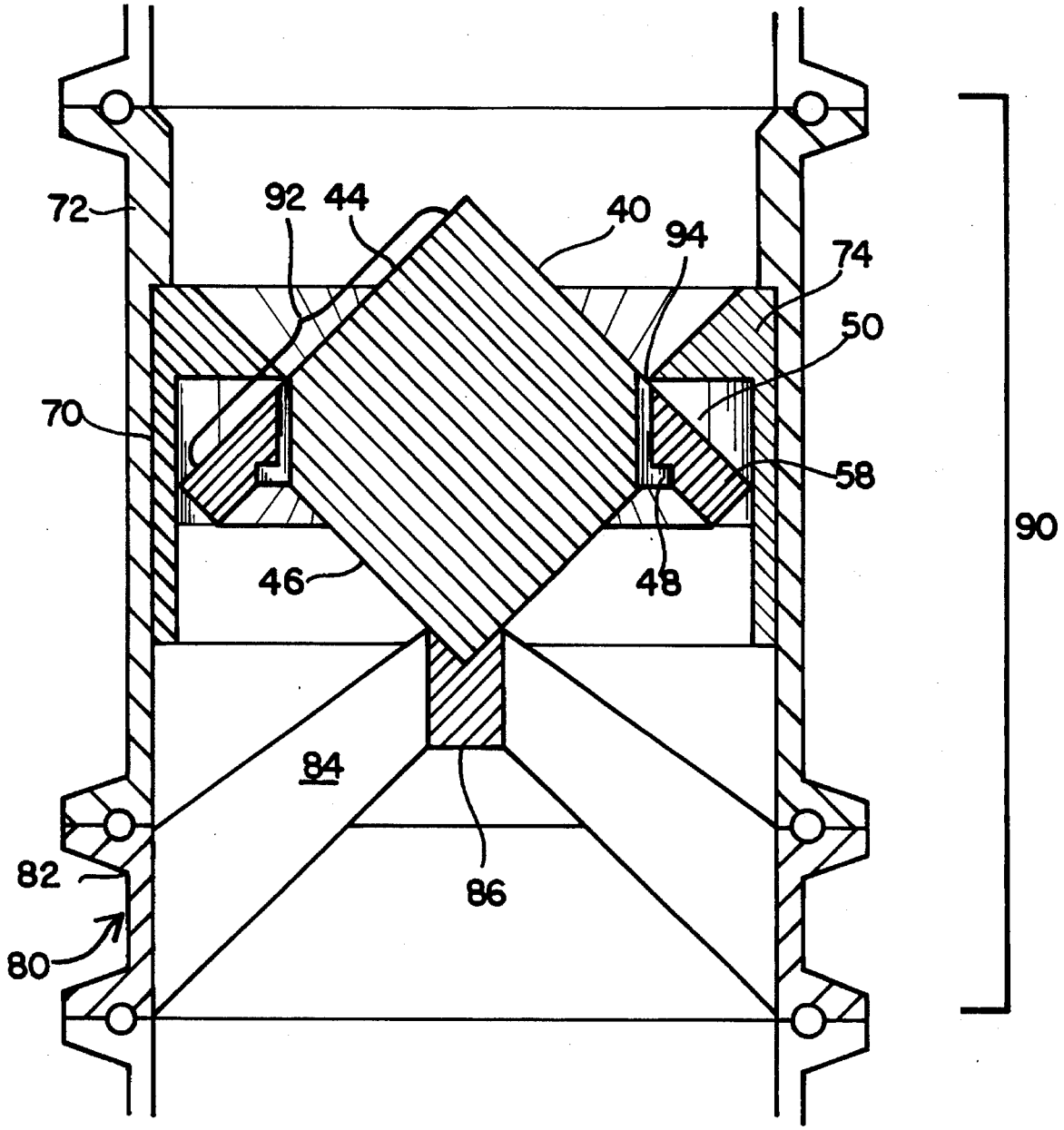
FIG. 6 is a cross view section of the break down embodiment of the in-line mixer.
Figure 7:
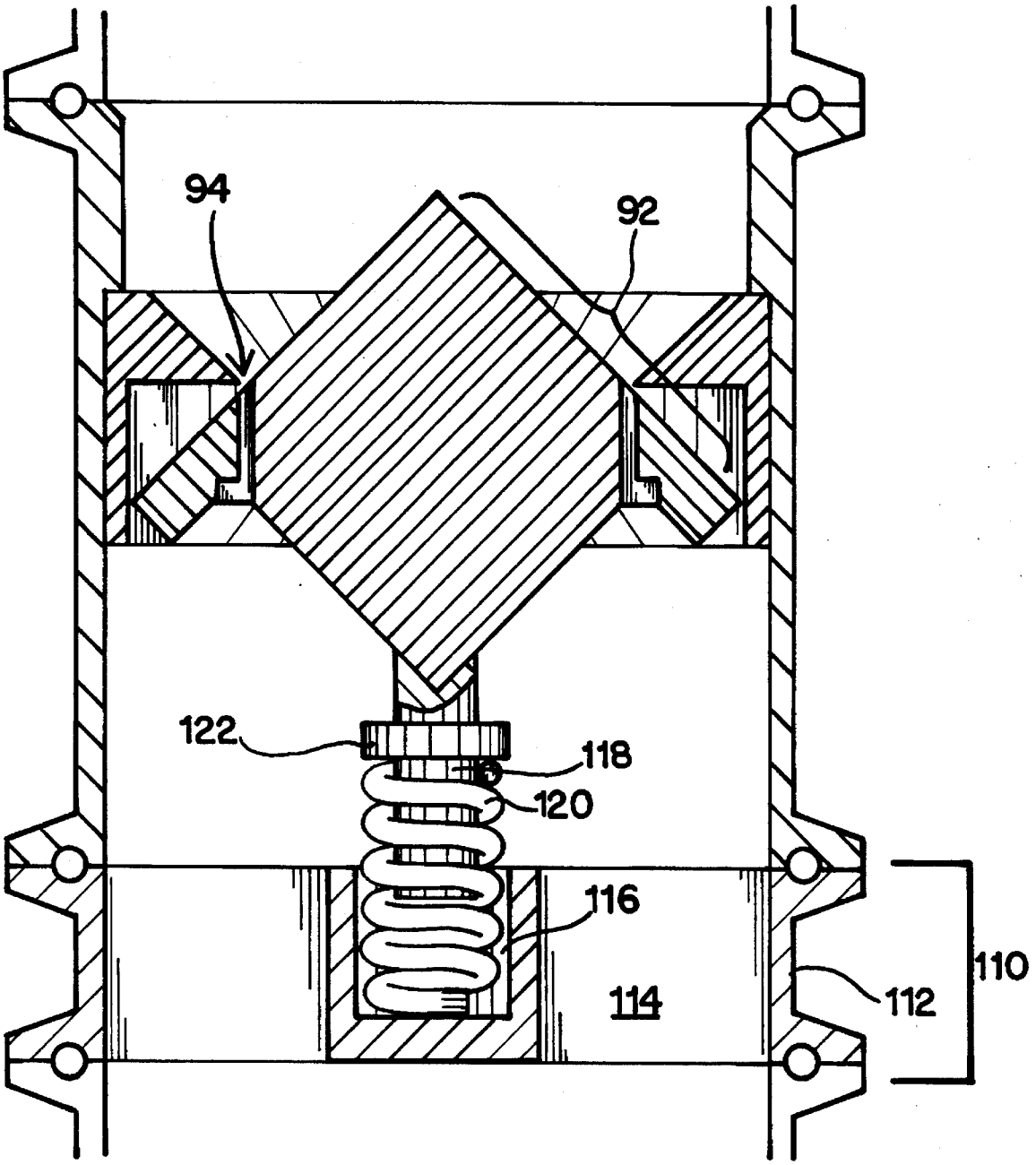
FIG. 7 is a partial cross view section of the pressure relief embodiment of the invention.
Figure 8:
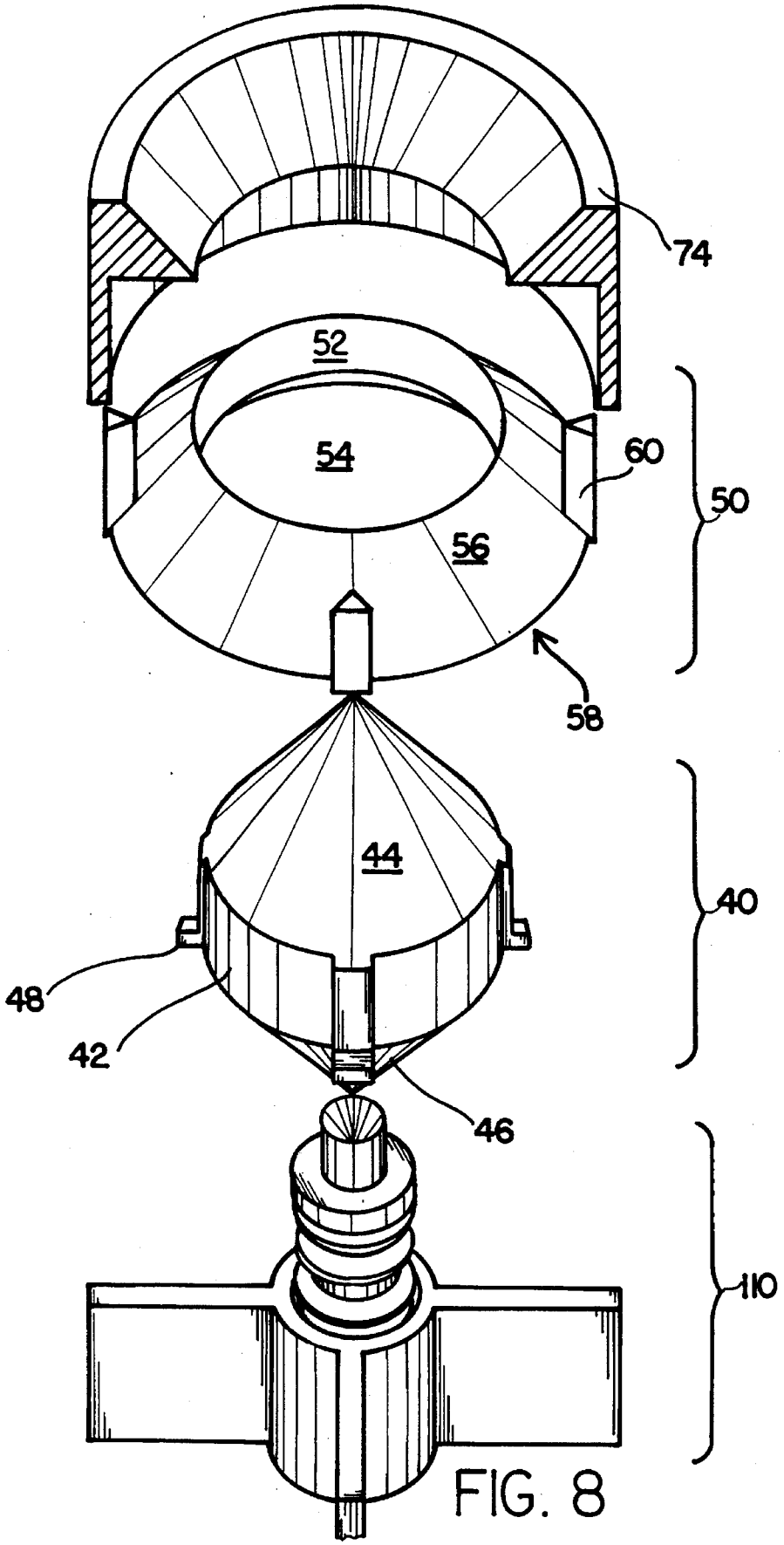
FIG. 8 is a partial cross-sectional view of the embodiment shown in FIG. 2, showing how the pieces are assembled.

Referring now to FIGS. 6–8, in another embodiment mixer 90 consists of inner shear head 40, outer shear ring 50, shear head housing segment 70 and support housing segment 80. This embodiment and the following embodiments were primarily designed for easy, complete breakdown of the mixer into it's component pans for washing, cleaning and inspection. Inner shear head 40 has an upstream conical shear face 44 and downstream conical shear base 46 and cylindrical midsection 42, as seen in FIG. 8. Cylindrical midsection 42 further has a plurality of outer ring mating sites 48. Here mating sites 48 are four dogs spaced equidistant around the outer circumference of midsection 42.

Outer shear ring 50 includes an annular obstruction body 52 and a plurality of shear head coupling means 60. Annular body 52 has an open center 54, an upper face 56 which is frustro-conical or partial cone shaped, and oppositely angled base section 58.

Here shear head coupling means 60 has four generally triangular shaped pegs which extend vertically upward from a point which is flush with the top of base section 58 to a height which is flush with the top of upper face 56. Upper face 56 slants away from pegs 60 in a manner such that pegs 60 extend upward in a vertical fashion.

Shear head housing segment 70 includes a tube or pipe 72 and annular obstruction seating ring 74. Annular ring 74 is located on the inside surface of pipe 72 such that the downstream end of outer ring 50 of assembled mixer shear head 90 is located downstream of ring 74 and the apical tip of inner shear head 40 is seated below the top of pipe 72, as can be seen in FIG. 8.

Support housing segment 80 consists generally of pipe 82, a plurality of support arches 84 and conical shear base dock 86. Support arches 84 are located on the inside surface of pipe 82 and converge such that the pair of arches meet and end at the sides of dock 86. Dock 86 has a notched upstream surface shaped to receive the most downstream apical portion of conical shear base 46 of inner shear head 40, as seen in FIG. 6.

Shear head housing 70 and support housing segment 80 are joined in sequence, with head housing 70 being located upstream of support housing 80. Head housing 70 and support housing 80 are here joined by quick release pressure bands but can be joined by any conventional removable fastening means, such as screws and bolts, clips, adjustable bands and the like.

In use, open center 54 of outer shear ring 50 fits over inner shear head 40. Shear ring 50 is oriented such that partial cone face 56 is facing in the upstream. In placing outer shear ring 50 over inner shear head 40, outer ring mating sites 48 interfit in an annular notch around the inner marginal downstream edge of outer shear ring 50. When outer shear ring 50 and inner shear head 40 are fitted together in this manner they form assembled mixer shear head 90. Assembled mixer head 90 has an upstream mixer shear head face 92, formed by surfaces 44 and 56, that has a plurality of bypass slots 94, here four in number. Slots 94 are arranged in a ring around the center line of seating ring 74 and pipe 72.

Slots 94 extend through the mixer shear head face 90 from its upstream side to its downstream conical base 46, thereby bypassing mixing region C. Mixing region C is the same as shown in FIG. 6. Slots 94, which may number from about two to about five, are arranged radially and generally evenly-spaced apart. Preferably, the center of each slot 94 is located so that it is at the same perpendicular distance from the inside surface of pipe 72 as the downstream, inner edge 76 of seating ring 74, as seen in FIG. 6. It is important to note the distance to the center of the slots 94 and the downstream conical base 46 may be varied in order to create more or less turbulence at the inlet to the slots 94, with more turbulence being developed with greater relative distance to the center of slots 94. The slots 94 are sized, such that in a plane perpendicular to the longitudinal axis of the pipe, the sum of the cross sectional area of the slots 94 is equal to the area between the pipe and the shear head.

Assembled mixer shear head 90 is located along the longitudinal axis of shear head housing pipe 72, with pegs 60 of outer ring 50 being in contact with and directly downstream of annular seating ring 74, as seen in FIG. 8. The apical portion of downstream conical base 46 is firmly seated in base dock 86 of support housing 80 when mixer 30 is assembled, as can be seen in FIG. 6.

In another embodiment, as seen in FIGS. 7 and 8, a different support housing segment is used to allow for pressure relief from mixtures that might tend to clog the assembled mixer. This embodiment has support housing segment 110, which generally includes pipe 112, support platform 114 with central recess 116, and conical shear base dock 118. Support platform 114 is located on the inside surface of pipe 112 and has central recess 116 for receiving compressible base dock 118, as can be seen in FIG. 7. Dock 118 has a compression means 120, here a conventional coil spring, and notched upstream surface shaped to receive the most downstream apical portion of conical shear base 46 of inner shear head 40. The downstream end of dock 118 is separated from the upstream end by flange 122. Flange 122 provides a purchase point for upstream end of compression means 120.

As in the other embodiments, the upstream side of annular seating ring 74 may also incorporate a smooth, tapered transition from the inside surface of pipe 72 to the upstream, inner edge of ring 74, or a rectangular, annular ring, with sharp upstream and downstream inner edges.

As material flows through mixer 90, intense shearing forces are created at the edge of the downstream side of annular seating ring 74 near the inlets of slots 94, at the edge of the downstream end of the upstream face of assembled mixer shear head 92 near the inside surface of pipe 72, and possibly near the outlet of slots 94.

Figure 9:
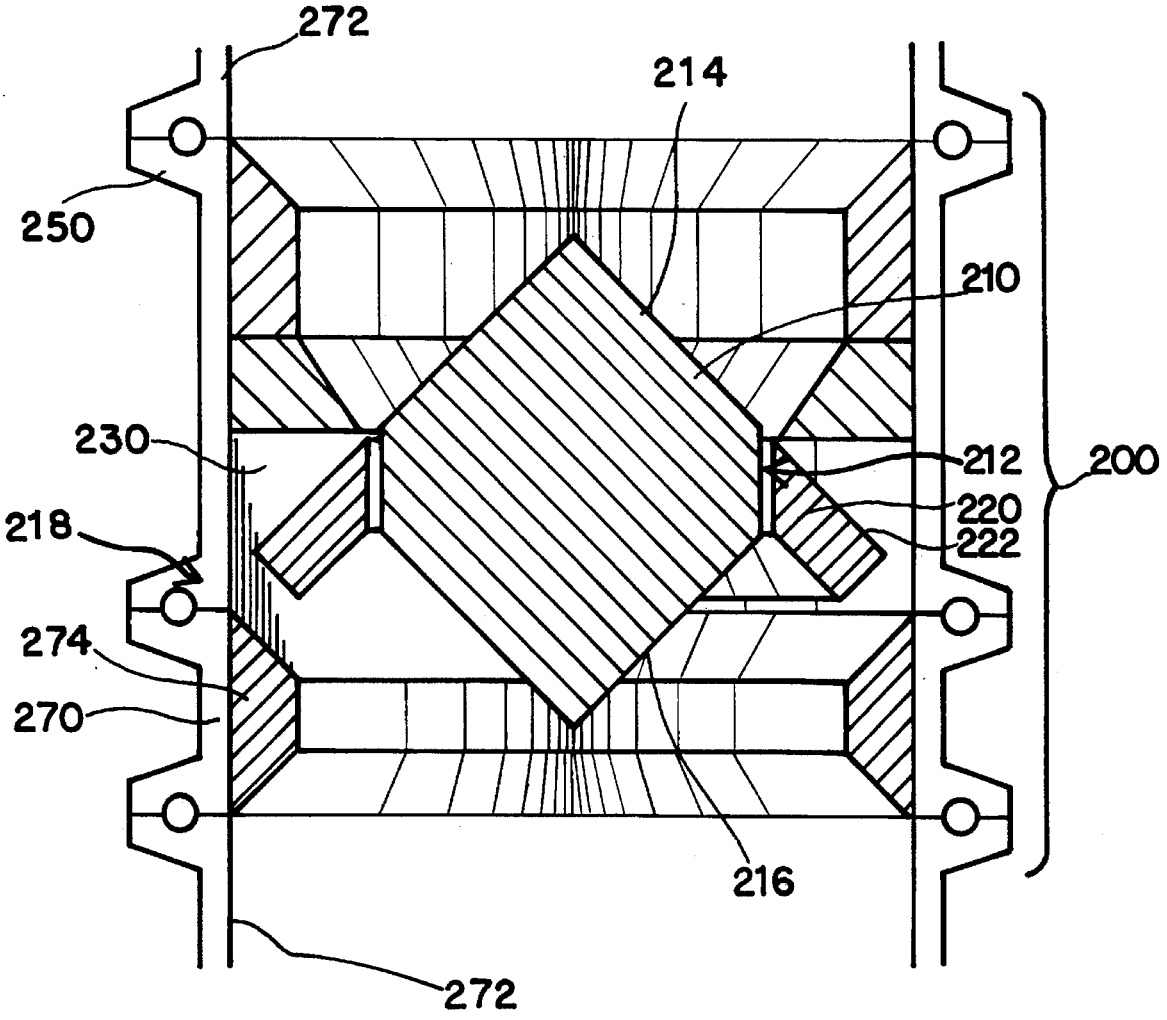
FIG. 9 is an isometric, partial cross-sectional view of another embodiment of the invention.
Figure 10:
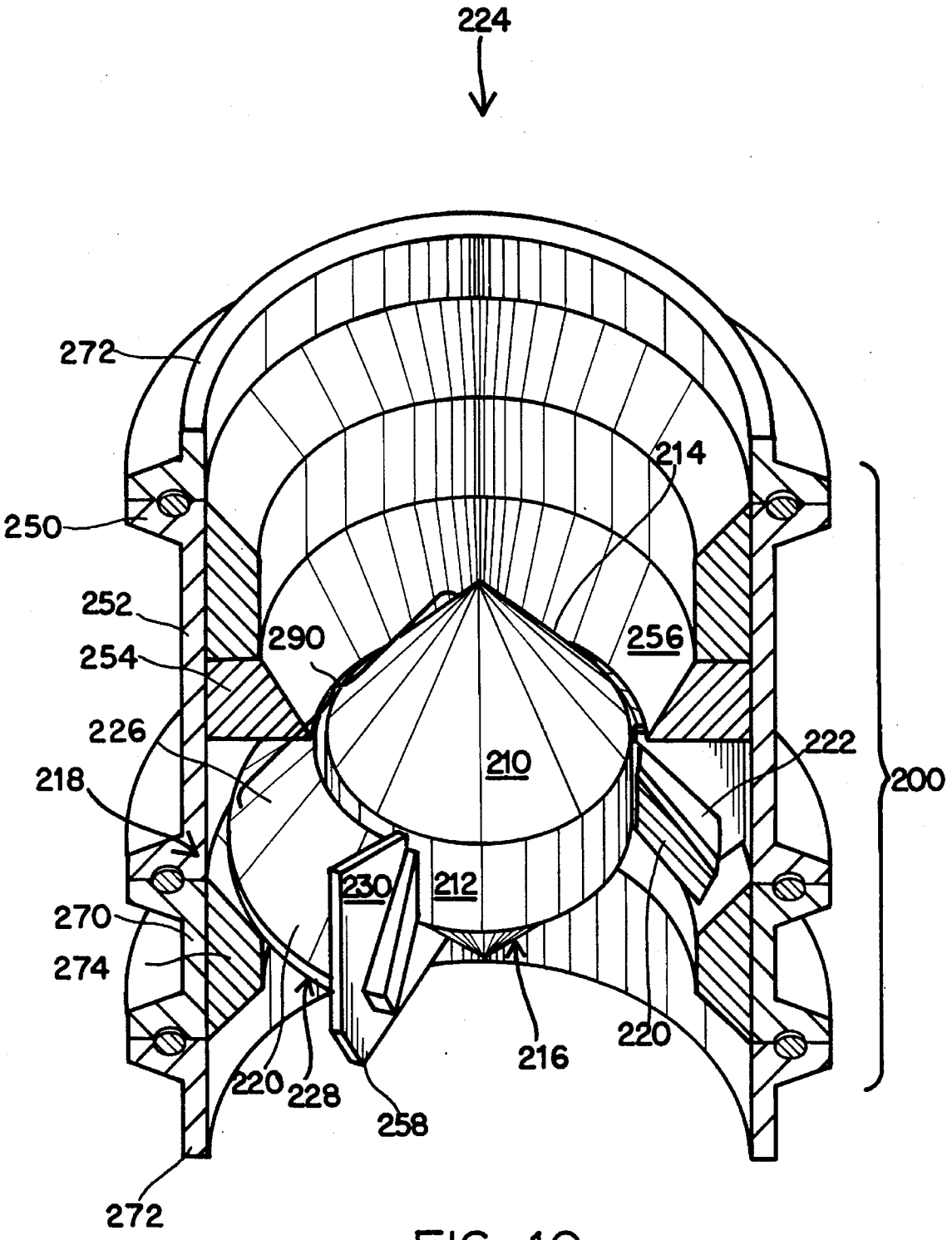
FIG. 10 is a partial cross-sectional view of the embodiment shown in FIG. 4, showing how the pieces are assembled.

Referring now to FIGS. 9 and 10, in another embodiment mixer 200 includes inner shear head 210, outer shear ring 220, orientation spacer 230, upstream shear head housing segment 250 and downstream support housing segment 270. Inner shear head 210 has an upstream conical shear face 214 and downstream conical shear base 216 and cylindrical midsection 212.

Outer shear ring 220 includes annular obstruction body 222 having an open center 224, an upper face which is frustro-conical or partial cone shaped, and oppositely angled base section 228, as seen in FIG. 10.

Upstream shear head housing segment 250 includes tube or pipe 252, annular obstruction placement ring 254 and annular obstruction upper cutting ring 256. Placement ring 254 is located on the inside surface of pipe 252 such that when mixer 200 is assembled the apical tip of upstream conical shear face 214 is below the upstream boundary of placement ring 254. Upper cutting ring 256 is located on the inside of surface of pipe 252 immediately below the downstream edge of placement ring 254.

Placement ring 254 has an outside surface, an inside surface, an upstream surface and a downstream surface. The outside surface is parallel to the longitudinal axis of pipe 252 and the inside surface is parallel to the outside surface of ring 254. The upstream surface converges inward from the it's upstream edge to it's downstream edge, as seen in FIG. 10. The downstream edge of ring 254 is perpendicular to the outside and inside surfaces of ring 254, as well as being perpendicular to the longitudinal axis of pipe 252, as seen in FIG. 10.

Downstream support housing segment 270 includes pipe 272 and support ring 274. Support ring 274 is welded to the inside of pipe 270, as seen in FIGS. 9 and 10. Support ring 274 has a partial cone shape cross-section, with a base and top that are perpendicular to the longitudinal axis of pipe 270. Upstream shear head housing 250 and downstream support housing segment 270 are joined in sequence, with shear head housing 250 being located upstream of support housing 270. Head housing 250 and support housing 270 are joined by quick release pressure bands but can be joined by any conventional removable fastening means, such as screws and bolts, clips, adjustable bands and the like.

In use, open center 224 of outer shear ring 220 fits over inner shear head 210. Shear ring 210 is oriented such that partial cone face 226 is facing in the upstream direction. Outer shear ring 220 is held in position in mixer 200 by a plurality, here three, of orientation spacers 230.

Spacer 230 is a thin, flat member shaped to have an upstream edge that is perpendicular to the longitudinal axis of pipe 252. The upstream edge of spacer 230 is parallel to and abuts against the downstream edge of upper cutting ring 256. Spacer 230 also has a back edge that is positioned flush with and parallel to inside wall of housing pipe 252 and a downstream edge that is parallel to the upstream edge and extends towards the center of pipe 272 and attaches to downstream conical base 216 of inner shear head 210 at attachment point 218. Spacer 230 is attached to downstream conical base 216 at point 218 by a small tab on 230 and a screw inserted into base 216. Other appropriate means of attachment of spacer 230 to base 216 could also be used; for example a tab on spacer 230 could be secured in a slot on base 216 or a tab could extend out from base 216 for securing to spacer 230. When outer shear ring 220 and inner shear head 210 are fitted together in this manner they form assembled mixer shear head 200. Assembled mixer head 200 has an upstream mixer shear head face 290, formed by surfaces 214 and 226, that has a bypass channel 294. Channel 294 is arranged in a ring around the center line of upper cutting ring 256 and pipe 252.

Figure 11:
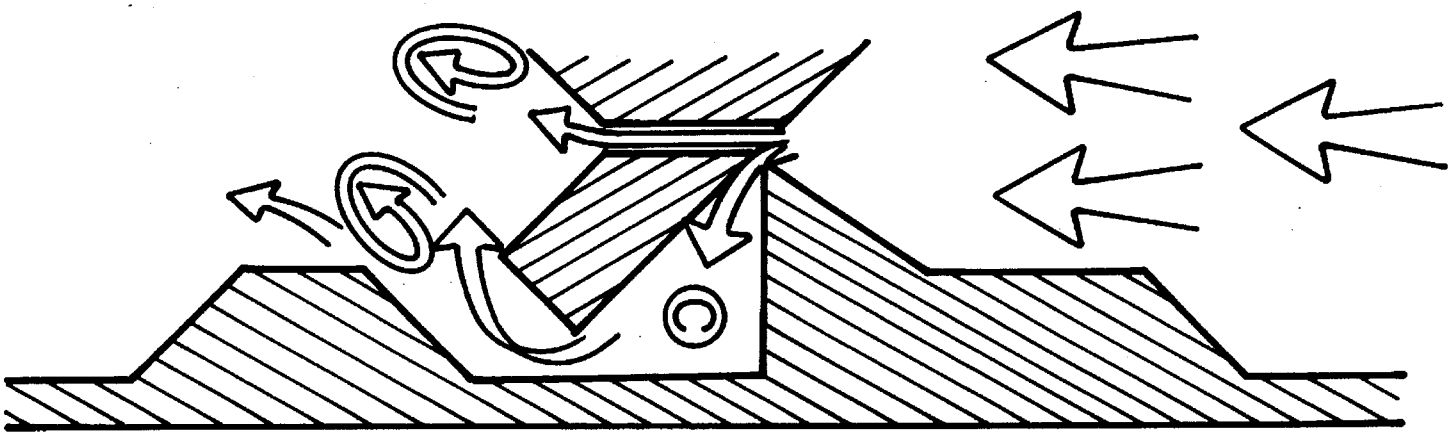
FIG. 11 is a schematic partial cross-sectional view showing the flow of material through the mixers shown in FIGS. 1–5.

Channel 294 extends through the mixer shear head face 290 from its upstream side to its downstream conical base 216, thereby bypassing mixing region C as shown in FIG. 11. Preferably, the center of channel 294 is located so that it is at the same perpendicular distance from the inside surface of pipe 252 as the downstream, the inner edge of upper cutting ring 256, as discussed in the other embodiments. It is important to note the distance to the center of the channel 294 and the downstream conical base 216 may be varied in order to create more or less turbulence at the inlet to the channel 294, with more turbulence being developed with greater relative distance, as previously described. The channel 294 is sized, such that in a plane perpendicular to the longitudinal axis of the pipe, the sum of the cross sectional area of channel 294 is equal to the area between the pipe and the shear head.

Assembled mixer shear head 200 is located along the longitudinal axis of shear head housing pipe 250, as seen in FIGS. 9 and 10.

As in the other embodiments, the upstream side of annular seating ring 254 may also incorporate a smooth, tapered transition from the inside surface of pipe 252 to the upstream, inner edge of ring 254, or a rectangular, annular ring, with sharp upstream and downstream inner edges. It is possible in any of the embodiments that the mixer could also be located in a single housing or tube rather than in upstream and downstream housing segments.

As material flows through mixer 200, intense shearing forces are created at the edge of the downstream side of annular seating ring 74 near the inlets of channel 294, at the edge of the downstream end of the upstream face of assembled mixer shear head 290 near the inside surface of pipe 252, and possibly near the outlet of channel 294.

It will therefore be understood that modifications and variations are possible without departing from the scope of the invention as expressed in the following claims.

I claim:

1. Apparatus for mixing comprising;

a) a tubular housing of known inside diameter having an inside surface, an upstream end for receiving unmixed material, and a downstream end for disgorging mixed material, said ends defining a longitudinal axis;

b) a first annular obstruction fixedly attached to the inside surface of said tubular housing for reducing the cross-sectional area inside of said tubular housing and accelerating material flow;

c) a second annular obstruction removeably attached immediately downstream of the first annular obstruction;

d) a third annular obstruction downstream of the second annular obstruction for creating a bypass channel;

e) a plurality of thin flat spacers positioned directly downstream of the second annular obstruction for holding the third annular obstruction in fixed spatial relationship with an inner shear an mixing head; and f) a cone shaped inner shear head comprising;

an upstream pointed end, an upstream conical face, a downstream conical base, a downstream pointed end and a cylindrical midsection, wherein the inner shear head is symmetric about a central axis defined by the upstream pointed end and the downstream conical base end; said inner shear head rigidly positioned within said tubular housing, wherein the central axis of the inner shear head is coincident with the centerline of the longitudinal axis of the housing, oriented with the upstream conical face directed upstream, with the cylindrical midsection concentric to the third annular obstruction, said inner shear head positioned downstream of the first annular obstruction, said first annular obstruction partially enveloping said inner shear head to define a first mixing zone within the first and second annular obstructions which communicate with the upstream end and a second mixing zone, said second mixing zone being within the confines of the tubular housing and inner shear head downstream of said annular obstruction and communicating with said first mixing zone and downstream housing end.

2. The apparatus of claim 1 wherein said flow mixer is adjustably positioned within said tubular housing such that it may be displaced along the longitudinal axis for the purpose of altering the clearance between said flow mixer and said annular obstruction.

3. An apparatus for mixing comprising;

a) a tubular housing of known inside diameter having an inside surface, an upstream end for receiving unmixed material, and a downstream end for disgorging mixed material, said ends defining a longitudinal axis;

b) a first annular obstruction fixedly attached to the inside surface of said tubular housing for reducing the cross-sectional area inside of said tubular housing and accelerating material flow;

c) a cone shaped flow mixer comprising;

an upstream pointed end, an upstream conical face, a cylindrical midsection with coupling means for a second annular obstruction, a downstream conical base, and a downstream pointed end, wherein the flow mixer is symmetric about a central axis defined by the upstream pointed end and the downstream conical base end; said flow mixer rigidly positioned within said tubular housing, wherein the central axis of the flow mixer is coincident with the centerline of the longitudinal axis of the housing, oriented with the upstream conical face directed upstream, said flow mixer positioned downstream of the first annular obstruction, said first annular obstruction enveloping said flow mixer to define a first mixing zone within the first annular obstruction which communicates with the upstream end and second mixing zone, and a second mixing zone within the confines of the tubular housing and flow mixer downstream of said annular obstruction which communicates with said first mixing zone and downstream housing end;

d) a second annular obstruction immediately downstream of the first annular obstruction, having a plurality of inner shear head coupling means, for forming a plurality of bypass slots; and e) a inner shear head support means having an upstream surface shaped to receive the downstream pointed end of the flow mixer.

4. The mixer of claim 3 wherein the inner shear head support means comprises a plurality or arches with a center notched surface.

5. The apparatus of claim 4 wherein said flow mixer is adjustably positioned within said tubular housing such that it may be displaced along the longitudinal axis for the purpose of altering the clearance between said flow mixer and said annular obstruction.

6. The mixer of claim 3 wherein the inner shear head support means comprises a flat platform with a pressure-responsive compressible center notched surface.

7. The apparatus of claim 6 wherein said flow mixer is adjustably positioned within said tubular housing such that it may be displaced along the longitudinal axis for the purpose of altering the clearance between said flow mixer and said annular obstruction.

8. A hydraulic shear mixer assembly which comprises:

(a) a housing having a longitudinal passageway of known diameter therethrough for the passage of liquids and suspended particulates from an upstream end to a downstream end;

(b) a plurality of annular shaped flow restrictors for accelerating said liquids and suspended particulates having a central opening, attached within said passageway, with its central opening in alignment with the longitudinal passageway;

(c) a conical shaped flow mixer having a major diameter less than that of said passageway positioned downstream of said annular shaped flow restrictor, fixed in proximity to said annular shaped flow restrictor thus defining a mixing zone wherein liquids and suspended particulates are accelerated through said annular shaped flow restrictor and around said conical flow mixer thereby inducing high shearing forces and mixing said liquids and suspended particulates; wherein said flow mixer further has a plurality of cylindrical bypass channels formed therethrough extending from the conical face to the base end of the flow mixer, radially disposed about the central axis, parallel to said central axis for bypassing material past the first mixing zone.

9. The apparatus of claim 8 wherein mixing is achieved without inducing air bubbles into said mixing zone.

10. The apparatus of claim 8 wherein said flow mixer is adjustably positioned within said tubular housing such that it may be displaced along the longitudinal axis for the purpose of altering the clearance between said flow mixer and said annular ring.

* * * * *